US005363116A

United States Patent [19]

Allen

[11] Patent Number: 5,363,116

[45] Date of Patent: Nov. 8, 1994

[54] SUPPORT ASSEMBLY FOR PORTABLE MICROWAVE ANTENNA

[75] Inventor: Carrol M. Allen, Northport, N.Y.

[73] Assignee: LNR Communications, Inc., Hauppauge, N.Y.

[21] Appl. No.: 90,660

[22] Filed: Jul. 13, 1993

[51] Int. Cl.[5] ..... H01Q 1/08

[52] U.S. Cl. ..... 343/881; 343/882; 248/170

[58] Field of Search ..... 343/878, 880, 881, 882, 343/890, 757; 248/168, 170, 528, 650; 52/114, 116, 150, 152; 211/203; H01Q 1/08

[56] References Cited

U.S. PATENT DOCUMENTS

| | | | |
|---|---|---|---|
| D. 160,680 | 10/1950 | Wilcox et al. . | |
| 20,669 | 6/1858 | Stone | 211/203 |
| 1,234,510 | 7/1917 | Trautwein | 248/170 |
| 2,474,250 | 6/1949 | Howard | 52/114 |
| 2,827,629 | 3/1958 | Rounsefell . | |
| 3,282,530 | 6/1964 | Rash | 248/170 |
| 3,611,393 | 10/1971 | Kibler | 343/761 |
| 4,799,642 | 1/1989 | Wright | 343/880 |
| 4,832,296 | 5/1989 | Schnepp | 248/168 |
| 5,061,945 | 10/1991 | Hull et al. | 343/840 |
| 5,233,809 | 8/1993 | Gropper | 343/882 |

*Primary Examiner*—Donald Hajec
*Assistant Examiner*—Tan Ho
*Attorney, Agent, or Firm*—Hoffmann & Baron

[57] ABSTRACT

A portable foldable support assembly for a microwave dish antenna in which three or more legs are hinged to a vertical center post near its upper end to engage the ground plane beyond the center of gravity of the antenna, and a torsional stabilizer secured to the lower end of the post having three or more moment arms respectively disposed circumferentially between adjacent pairs of legs and in which a pair of tension members couple the lower end of each leg to two adjacent moment arms on opposite sides of the central axis to resist rotation of the post in either direction.

9 Claims, 3 Drawing Sheets

SUPPORT ASSEMBLY FOR PORTABLE MICROWAVE ANTENNA

This invention relates to antennas and more particularly to portable support structures for holding microwave dish antennas in their operative modes at randomly selected sites.

BACKGROUND OF THE INVENTION

Microwave communication is dependant on precision antenna mounting including stabilization of aim in altitude and azimuth with respect to the remote counterpart source or target antenna. In the case of portable antennas there is an obvious trade-off between the mass or complexity of the support structure and antenna stability. U.S. Pat. Nos. 2,827,629, 4,799,642 and 5,061,945 are examples of the present state of the art in portable and semi-portable dish antenna support structures. They are massive; clumsy and time consuming in assembly and disassembly; present complicated, multiple packaging for transport; and share with all designs a vulnerability to torsional load displacement deriving from wind on the dish.

The present invention, therefore, has for its objects and features an antenna support design in which weight is minimized; foldability quickly presents a compact, manageable package for transport; and the ability of the support to resist torsional loading on the surmounted dish is achieved with minimized weight and at low cost.

BRIEF SUMMARY OF THE INVENTION

A central torsion-resistant post, which supports the tiltable and rotatable antenna dish assembly, is stabilized against movement by an articulated leg assembly, preferably a tripod. The three legs are pinned at equi-angularly spaced points in a collar firmly attached near the upper end of the post and splayed outward and downward to the ground plane through vertically-adjustable foot pads.

The lower end of the post is coupled to a radially enlarged base adjacent the ground plane and which affords 3 radially extending moment arms which are respectively angularly centered between the legs. Thus the arms form an angle of 60° with each of the pair of proximate legs. Two tension members, preferably in the form of flexible wire cable, connect each leg at its lower end to the two proximate moment arms. Each leg is, therefore, effectively tied to the center post on opposite sides of the vertical centerline of the post and thereby opposes both clockwise and counterclockwise movement of the post under wind loads on the antenna. In all, therefore, 3 cables at all times resist one hand of antenna displacement and 3 the other. The legs are compression members which resist bending and therefore resist tilting of the post when it is coupled by the cables to the legs. The weight of the antenna assembly is picked up by the legs, freeing the post of compression forces below the junction with the legs. The post can, therefore, be designed for the primary function of torsion resistance, thereby conserving mass.

The structure is articulated so that it is foldable for portability. Bracing by means of compression links running from the base to the legs prevents twisting forces on the post under high wind loads from inching the legs inward to cause slack in the tension wires and to prevent angular movement of any leg which might be momentarily lifted from the ground. If desired, the size of the folded assembly can be further reduced by hinging the three moment arms on horizontal axes close to the post.

DESCRIPTION OF THE PREFERRED EMBODIMENT

Figure 1:
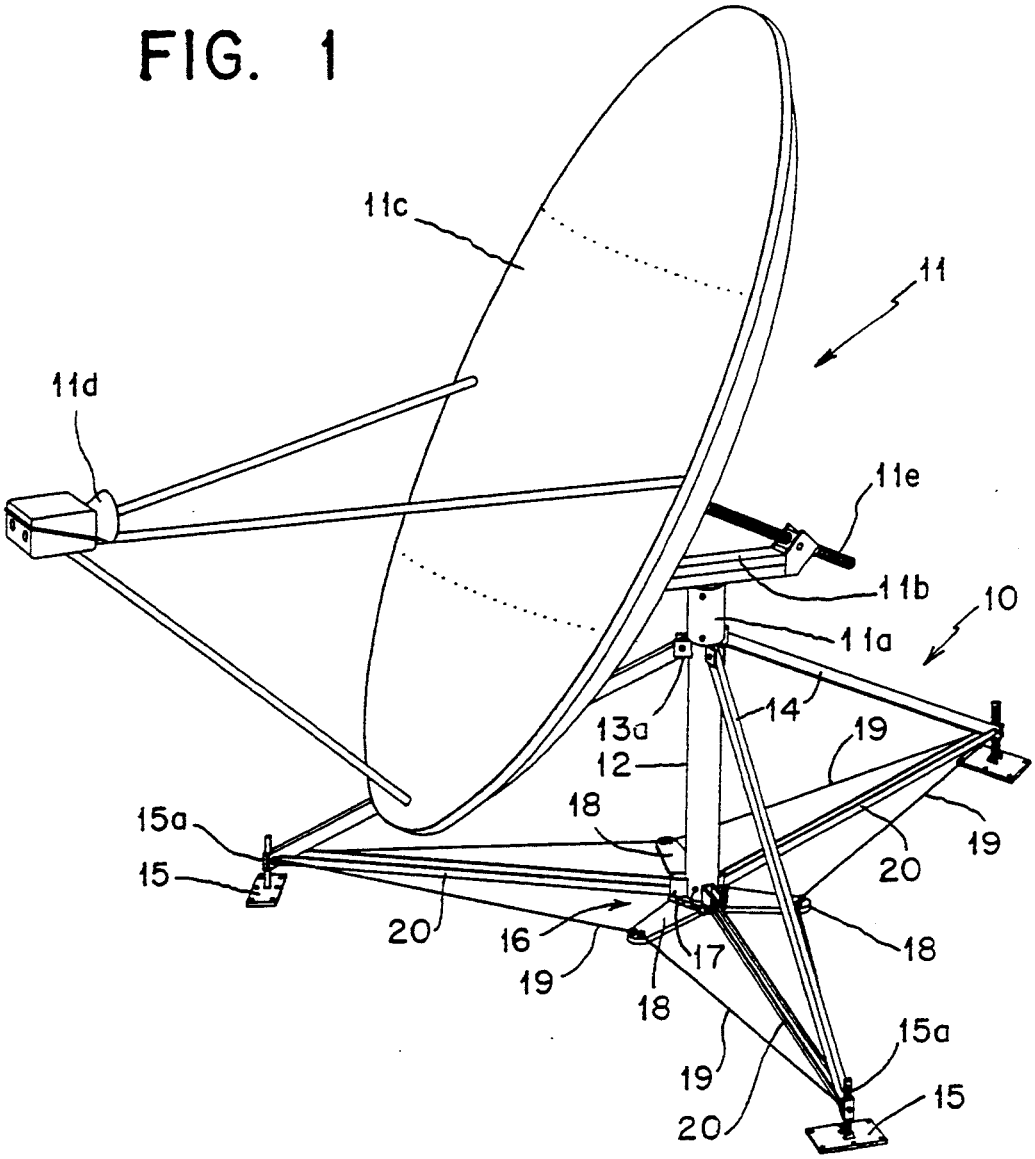
FIG. 1 is a view in perspective of a conventional portable microwave dish antenna carried by a foldable portable support assembly in accordance with the present invention.

Referring to FIG. 1, the invention is illustrated as embodied in a portable support structure 10 for a conventional portable antenna unit 11 including a mounting collar 11*a*, a frame 11*b* carrying a reflector dish 11*c* (adapted to be broken down into 3 pieces for transport) and a horn 11*d* tripod mounted at the focal point of the dish. The antenna is adjustable in azimuth by means of the collar 11*a* and in attitude by the lead screw 11*e*, all as known in the art.

Figure 2:
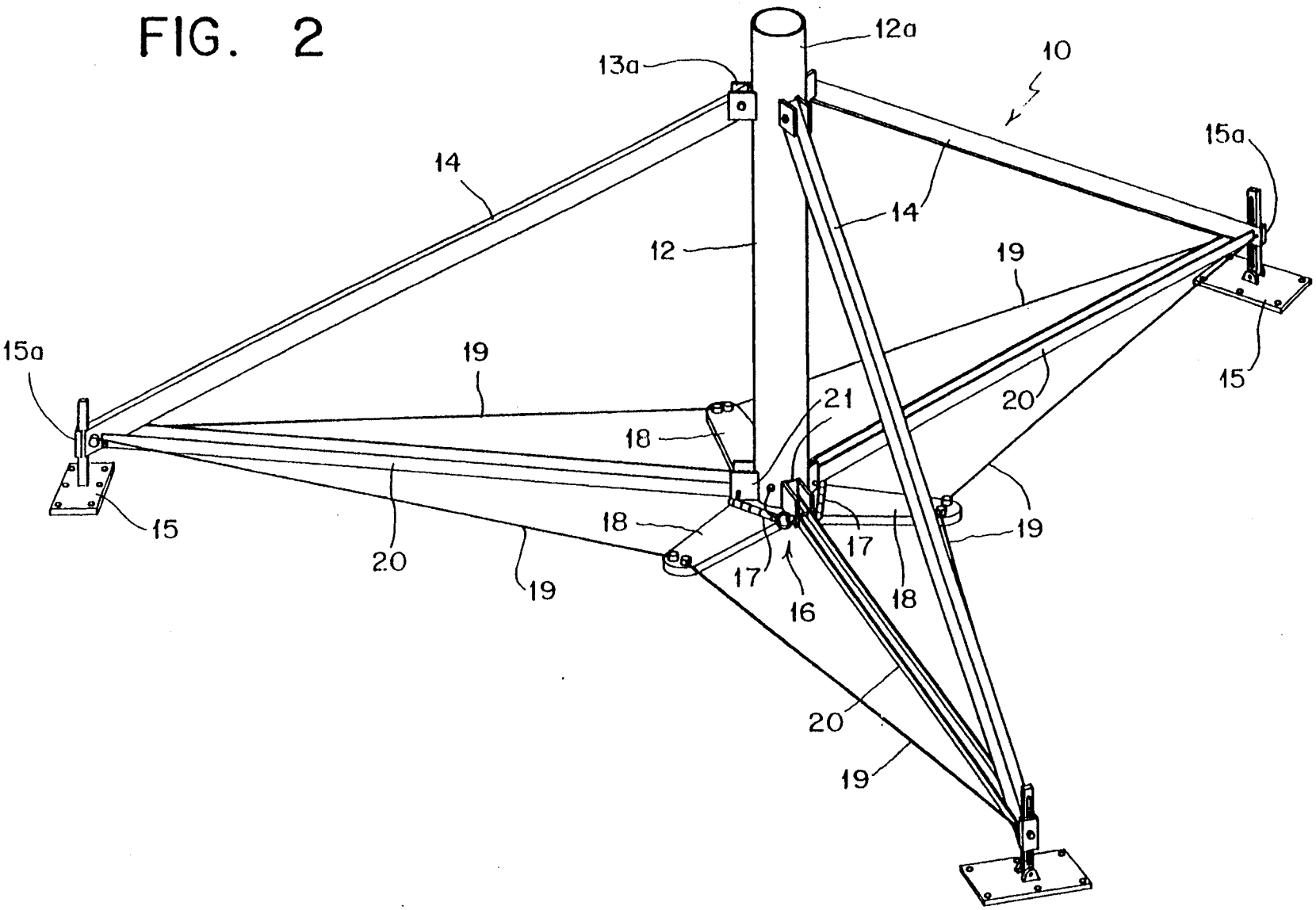
FIG. 2 is an enlarged view in perspective of the support assembly in its erected mode.
Figure 3:
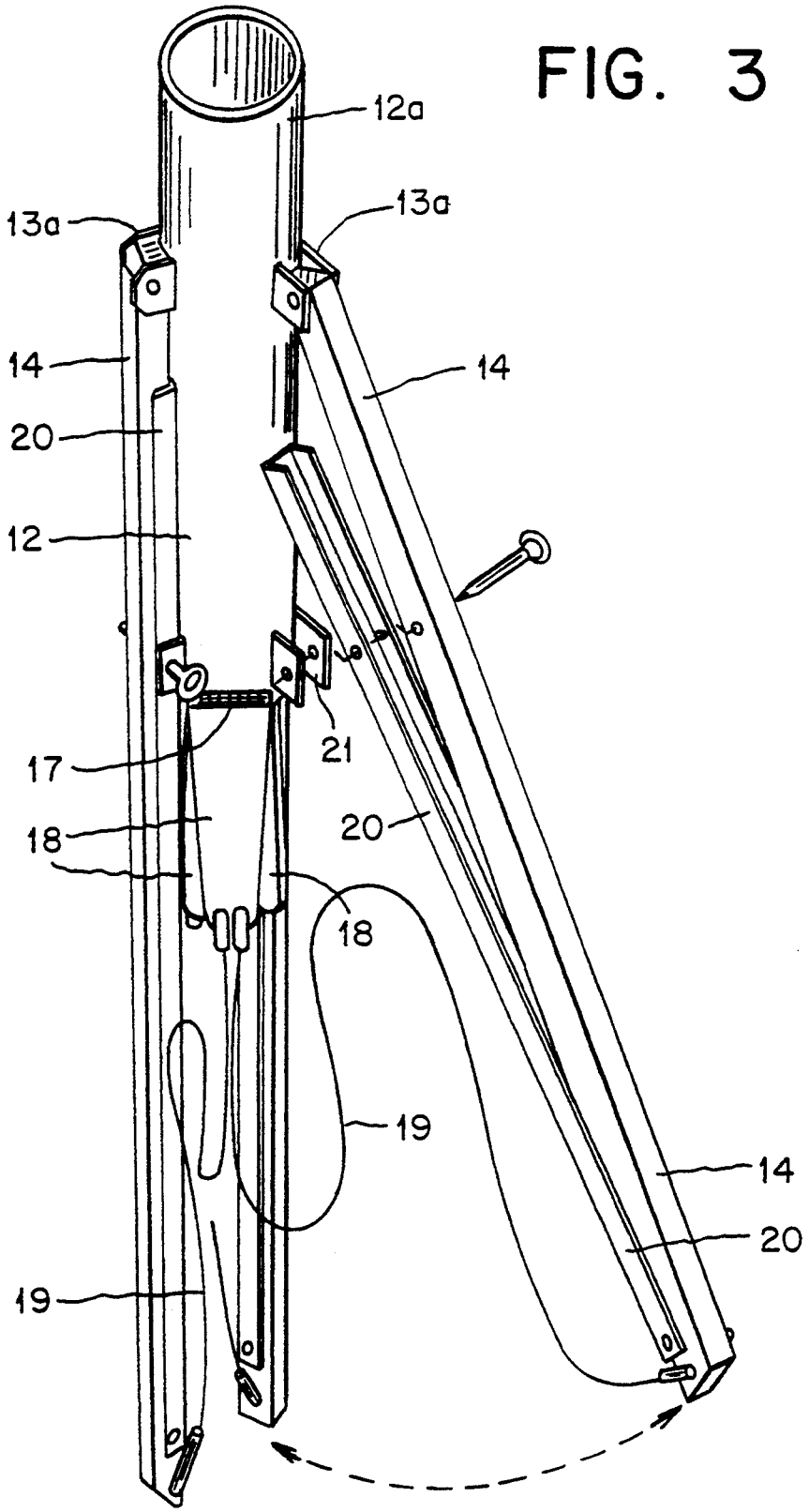
FIG. 3 is a view in perspective of the antenna support assembly close to its fully folded state for transport or storage.

The portable support structure 10, illustrated separately in FIG. 2, is an articulated unitary structure shown in its open or working mode in FIGS. 1 and 2 and in a partially folded mode in FIG. 3. The central support member is a tubular post or column 12 configured to sustain torsional loads. The upper end 12*a* of the column fits within the mounting collar 11*a* of the antenna which bears on vertical pad-pairs 13*a* arranged at 120 degree angles around the circumference. Permanently pivotally mounted in the respective pad-pairs are legs 14 to form a tripod configuration in which the weight of the antenna unit is transferred to the legs at their junctions with the collar 11*a*. The legs carry substantial compression and bending loads and can be formed, for example, of box beam stock. The legs splay outward at a relatively shallow angle, 20 to 30 degrees being typical, and have attached at their outer ends ground pads 15 which pivot on vertical adjustment posts 15*a* in a conventional manner. A wide range of ground pad configurations can be used to suit a variety of terrains.

Secured to the lower end of the column 12 adjacent the ground plane is a torsion control assembly 16 comprising an inner pad 17 secured to the column 12 having pinned thereto by means of relatively long horizontal hinge pins 17, three equi-angularly spaced, i.e. 120 degrees apart, moment arm legs 18 which preferable lock against upward pivotal moment beyond the ground plane. The length of the moment arm legs is a function of material strength, antenna geometry and anticipated wind loads. In general the length should substantially exceed the diameter of the central column 12 on the order, for example, of 2 to 4 times. The angular positioning of the torsion control assembly on the column 12 is such that the moment arms 18 are substantially centered between the legs 14 or in the illustrated embodiment at 60 degree angles to both proximate legs.

Tension members 19, all co-planar as illustrated, join the lower ends of the legs 14 to the moment arms 18, with each leg having two such members connected to the outer ends of the two proximate moment arms. Thus, as viewed from the outer end of each leg, one tension member connects to the left hand moment arm to resist clockwise turning of the central column and the other connects to the right hand moment arm to resist counterclockwise rotation. The length of the moment arms is less than the distance to the cord line between the lower ends of adjacent legs so that an angle is formed between the respective right and left hand tension members of adjacent legs where they join their common moment arm. The tension members should not be disposed beyond the cord line between the adjacent legs.

As described above, the system is fully functional to control unwanted axial turning movement of the central column 12. The column 12 is relieved of the weight of the antenna by the legs 14 at their junctions with the column, enabling weight reduction in the design of the column below the junction. The lower end of the column is able, therefore, to ride above the ground, secured against both lateral and torsional displacement by the torsion control assembly 16.

Control of downward angular motion of the pivoted legs is imparted by compression beams 20 coupling the torsion control assembly 16 to the respective legs. In the illustrated arrangement the compression beams 20 are permanently pinned in a hinge coupling near the lower ends of the legs. The inner ends are detachably pinned to the lower end of the central column by means of brackets 21 disposed between the hinges 17. The beams are in the form of channels to receive the box beam of which the legs are formed when the support assembly is detached from the antenna assembly and folded as seen in FIG. 3.

It will be understood that the legs 14, while bearing the weight of the antenna unit above, are relieved of the torsional forces which the antenna imposes on the central column 12 under wind loads. Thus the legs, like the central column, can be configured in cross section to meet the design specifications at minimum weight.

Referring to FIG. 3, the assembly is shown partially folded. This is accomplished by unpinning the compression beams from the lower end of the column 12, and swinging the beams toward the legs on the pivot joint therebetween. The beams and legs then together fold into the brackets 21 and all three are pinned through appropriate holes to lock the system closed. Meantime, the moment arms are swung toward the axis of the column 12, while the tension members or cables 19 fold upon themselves, and are confined by the folded legs.

While the invention has been illustrated and described in one preferred embodiment, it will be understood that it can take other forms all in accordance with the invention. For example, a quadrapod configuration is a natural and obvious extension of the design. Also, the tension members 19 shown as cable can be bar-or tubular-form to impart compression strength and thereby duplicate more or less the function of the compression bars 20, which can be omitted. While the moment arm for each tension member is approximately but not quite at its optimum length, i.e. the tangent line from the leg to the horizontal circle circumscribing the movement arm assembly, such can be achieved by laterally enlarging the outer ends of the arms 18 and cross-attaching the two cables at the end of each arm in a circumferentially overlapping fashion. Also, the compression bars 20 can be coupled to the legs 14 at other points along the leg, thereby reducing length and weight. The invention also lends itself to all conventional supplementary stabilizing techniques such as staking the rig down by stakes and cables or providing a ground-secured second central post of smaller o.d. than the i.d. of the central post 12 to fit concentrally therein for imparting supplementary lateral support and, with a key-way, supplementary torsional support. The invention should not, therefore, be regarded as limited except as set forth in the following claims.

I claim:

1. A portable support for a microwave antenna comprising:

(a) a central vertical torsion-resistant post to carry the antenna at its upper end;

(b) a plurality of at least three compression legs secured at substantially equi-angularly spaced points adjacent the upper end of the post and extending angularly downward to the ground plane at points substantially beyond the center of gravity of the antenna, adjacent legs forming a pair of legs;

(c) a stabilizing assembly attached to the post adjacent its lower end and having radially extending means to define at least three angularly spaced apart moment arms each approximately centered between each said pair of legs; and (d) a pair of angularly divergent tension members for each leg connecting the lower end of the leg to the adjacent moment arms on either side of the leg.

2. An antenna support as set forth in claim 1 including compression members between the legs and the central post at a point below the junction of the legs with the post to preclude angular motion of the legs in a vertical plane.

3. An antenna as set forth in claim 2 in which the compression members join the lower end of the post and the lower ends of the legs.

4. An antenna support as set forth in claim 3 in which the compression members are pivotally connected at one end and detachably connected at the other, and the legs are pivotally attached to the post, whereby the support can be folded for transport.

5. An antenna support as set forth in claim 1 in which the tension members are flexible cables.

6. An antenna support as set forth in claim 5 in which the angularly divergent tension members also constitute compression members to restrain angular movement of the legs in all planes.

7. An antenna support as set forth in claim 1 in which the legs are pivotally attached to the post, whereby the support can be folded for transport.

8. An antenna support as set forth in claim 7 in which the moment arms each comprise a radial compression arm pivotally connected at the lower end of the post, whereby the support can be folded for transport.

9. An antenna support as set forth in claim 1 including vertically adjustable foot pads at the lower ends of the legs.

* * * * *